US007434980B2

(12) United States Patent
Bolind et al.

(10) Patent No.: US 7,434,980 B2
(45) **Date of Patent: *Oct. 14, 2008**

(54) SWINGING AGITATOR FOR A GYPSUM CALCINING APPARATUS AND THE LIKE

(75) Inventors: Michael L. Bolind, Ingleside, IL (US); Michael J. Porter, Akron, IN (US)

(73) Assignee: United States Gypsum Company, Libertyville, IL (US)

( * ) Notice: Subject to any disclaimer, the term of this patent is extended or adjusted under 35 U.S.C. 154(b) by 73 days.

This patent is subject to a terminal disclaimer.

(21) Appl. No.: 11/505,652

(22) Filed: Aug. 17, 2006

(65) Prior Publication Data

US 2006/0274604 A1 Dec. 7, 2006

Related U.S. Application Data

(63) Continuation-in-part of application No. 10/788,864, filed on Feb. 27, 2004, now Pat. No. 7,121,713.

(51) Int. Cl.

| | |
|---|---|
| ***B28C 5/06*** | (2006.01) |
| ***B28C 5/08*** | (2006.01) |
| ***B01F 11/04*** | (2006.01) |
| ***B01F 13/02*** | (2006.01) |

(52) U.S. Cl. ..... 366/3; 366/102; 366/276; 366/332

(58) Field of Classification Search ..... 366/3, 366/64, 102, 103, 276, 332, 101; 209/138
See application file for complete search history.

(56) References Cited

U.S. PATENT DOCUMENTS

| | | | | |
|---|---|---|---|---|
| 86,002 | A * | 1/1869 | Coffman | 366/332 |
| 137,496 | A * | 4/1873 | Snow | 366/332 |
| 621,934 | A * | 3/1899 | Multon | 366/276 |
| 2,261,872 | A | 11/1941 | Choate | |
| 3,236,509 | A | 2/1966 | Blair | |

(Continued)

FOREIGN PATENT DOCUMENTS

| | | | |
|---|---|---|---|
| DE | 169 737 | A1 | 4/1906 |

(Continued)

OTHER PUBLICATIONS

Page from Babcock-BSH catalog showing rotary drum calciners with coolers. Germany. Such rotary calciners were first used in 1925.

(Continued)

*Primary Examiner*—Tony G Soohoo
(74) *Attorney, Agent, or Firm*—Marshall, Gerstein & Borun LLP

(57) ABSTRACT

An agitation mechanism for a gypsum processing apparatus which includes a housing having a bottom wall and at least one side wall. The housing can be constructed and arranged to receive and process gypsum-based products. An agitator frame having a similarly shaped cross-section to the cross-section of the housing is provided and positioned adjacent the bottom wall of the housing. The agitator frame is pivotally connected internally to the housing for reciprocating movement between first and second positions. The agitation mechanism is operable for preventing fluid channeling to ensure good fluidization of the gypsum products from collecting adjacent the bottom wall of the housing.

32 Claims, 11 Drawing Sheets

U.S. PATENT DOCUMENTS

| | | | |
|---|---|---|---|
| 3,307,840 | A | 3/1967 | Conroy, Jr. |
| 3,378,246 | A | 4/1968 | Leding |
| 3,576,599 | A | 4/1971 | Anderson et al. |
| 3,669,435 | A | 6/1972 | Silverberg |
| 3,871,829 | A | 3/1975 | Keith et al. |
| 3,901,645 | A | 8/1975 | Rowland |
| 4,113,836 | A | 9/1978 | O'Connor |
| 4,117,070 | A | 9/1978 | O'Neill |
| 4,161,390 | A | 7/1979 | Page et al. |
| 4,176,157 | A | 11/1979 | George et al. |
| 4,188,186 | A | 2/1980 | Ladwig |
| 4,215,981 | A | 8/1980 | von Dreusche, Jr. |
| 4,227,873 | A | 10/1980 | Manshausen et al. |
| 4,238,238 | A | 12/1980 | Kinkade et al. |
| 4,522,587 | A | 6/1985 | Miller |
| 4,576,573 | A | 3/1986 | Ruehenbeck |
| 4,626,199 | A | 12/1986 | Bounini |
| 4,629,419 | A | 12/1986 | Ward et al. |
| 4,744,961 | A | 5/1988 | Bounini |
| 4,744,963 | A | 5/1988 | Bounini |
| 4,915,623 | A | 4/1990 | Ball et al. |
| 5,011,668 | A | 4/1991 | Ball et al. |
| 5,139,749 | A | 8/1992 | White |
| 5,333,597 | A | 8/1994 | Kirkpatrick et al. |
| 5,520,884 | A * | 5/1996 | Croucher ..... 366/240 |
| 5,743,728 | A | 4/1998 | Cloud et al. |
| 5,743,954 | A | 4/1998 | Rowland et al. |
| 5,927,968 | A | 7/1999 | Rowland et al. |
| 5,954,497 | A | 9/1999 | Cloud et al. |
| 7,121,713 | B2 * | 10/2006 | Bolind et al. ..... 366/3 |
| 2005/0190645 | A1 * | 9/2005 | Bolind et al. ..... 366/276 |

FOREIGN PATENT DOCUMENTS

| | | | |
|---|---|---|---|
| DE | 1 558 080 | A1 | 1/1970 |
| GB | 1 018 464 | A1 | 1/1966 |
| GB | 1087549 | A1 | 10/1967 |
| GB | 1198807 | A1 | 7/1970 |
| GB | 1488665 | A1 | 10/1977 |
| GB | 2043219 | A1 | 10/1980 |

OTHER PUBLICATIONS

Page from Krupp Polysius catalog showing POLCAL calcining system. Netherlands. One such calcining system was in use starting in 1993.

British Gypsum Limited, "High Efficiency Calcining of Gypsum", 1998, pp. 1-8.

Declaration of Michael L. Bolind Re Information Disclosure Statement, dated Apr. 29, 2008 (5 pages including Exhibit A).

* cited by examiner

SWINGING AGITATOR FOR A GYPSUM CALCINING APPARATUS AND THE LIKE

CROSS-REFERENCE TO RELATED APPLICATIONS

This application is a continuation-in-part of and claims the benefit of U.S. patent application Ser. No. 10/788,864, filed Feb. 27, 2004, now U.S. Pat. No. 7,121,713, the entire contents of which are hereby expressly incorporated herein by reference.

FIELD OF THE DISCLOSURE

The present invention relates to a method and apparatus for agitating gypsum product.

BACKGROUND OF THE INVENTION

Calcining of gypsum comprises converting calcium sulfate dihydrate by heating into calcium sulfate hemihydrate, better known as stucco. Prior calcining apparatus and methods have taken various forms. Traditionally, the calcining of gypsum has occurred in a large kettle, having a thickened dome-shaped bottom, against which a gas-fired flame is directed, with the kettle and burner flame being enclosed in a suitable refractory structure. There is usually an associated hot pit into which the calcined material is fed. The kettle must withstand temperatures in the 2,000°-2,400° F. range, hence requiring expensive fire box steel plate on its domed bottom, which was typically 1¾ inches thick. U.S. Pat. No. 3,236,509 typifies this type construction. This approach had numerous disadvantages, such as the extreme waste of hot burner gases, and the associated refractory brick enclosure which, when repairs or kettle shut-down were needed, first required a lengthy cool-down period.

After the gypsum has been calcined, further processing is sometimes required. The calcined gypsum, or stucco, can be placed in a fluid bed stucco cooling apparatus wherein water is sprayed into the apparatus to cool the stucco to a predetermined temperature. In addition, other types of stucco processing apparatus are known such as a cooling coil fluid bed stucco treaters where the stucco is cooled with a cooling coil that is positioned within the apparatus to control the temperature of the stucco. Other processing apparatus such as post-stucco treatment retention devices can be used in the manufacture of gypsum-based products.

SUMMARY OF THE INVENTION

The present invention provides for an agitation mechanism for a gypsum processing apparatus which includes a housing having a top wall, a bottom wall, and at least one side wall. The housing can be constructed and arranged to receive and process gypsum-based products. A fluidization mechanism can be provided for delivering fluid to the gypsum-based products. An agitator frame having a similarly shaped cross-section to the cross-section of the housing is provided and positioned adjacent the bottom wall of the housing. The agitator frame is pivotally connected internally to the housing for reciprocating movement between first and second positions. The agitation mechanism is operable for preventing channeling of the fluid through the gypsum, ensuring good fluidization, and preventing gypsum product from collecting adjacent the bottom wall of the housing. The agitation mechanism can include a plurality of agitation members connected to the frame for agitating the gypsum product adjacent the bottom wall when the agitator frame moves. The agitation mechanism can also include at least one pivotal support arm for pivotally connecting the frame to the apparatus.

The agitation mechanism can be used in a fluidized stucco cooler utilizing water injection. The agitation mechanism can be used in a fluidized bed stucco cooler utilizing cooling coils. Further, the agitation mechanism can also be used in a post-stucco treatment retention device.

A method is provided for agitating gypsum based material in a processing housing. The gypsum based material is delivered to the housing, and an agitation mechanism having a frame with agitation members attached thereto is positioned adjacent the bottom wall of the housing. The agitation mechanism is moved between first and second positions to agitate the fluidized material in the housing to prevent material from coagulating near the bottom of the housing and to prevent fluid channeling and dead zones of non fluidized gypsum.

Other applications of the present invention will become apparent to those skilled in the art when the following description of the best mode contemplated for practicing the invention is read in conjunction with the accompanying drawings.

DETAILED DESCRIPTION OF THE INVENTION

Figure 1:
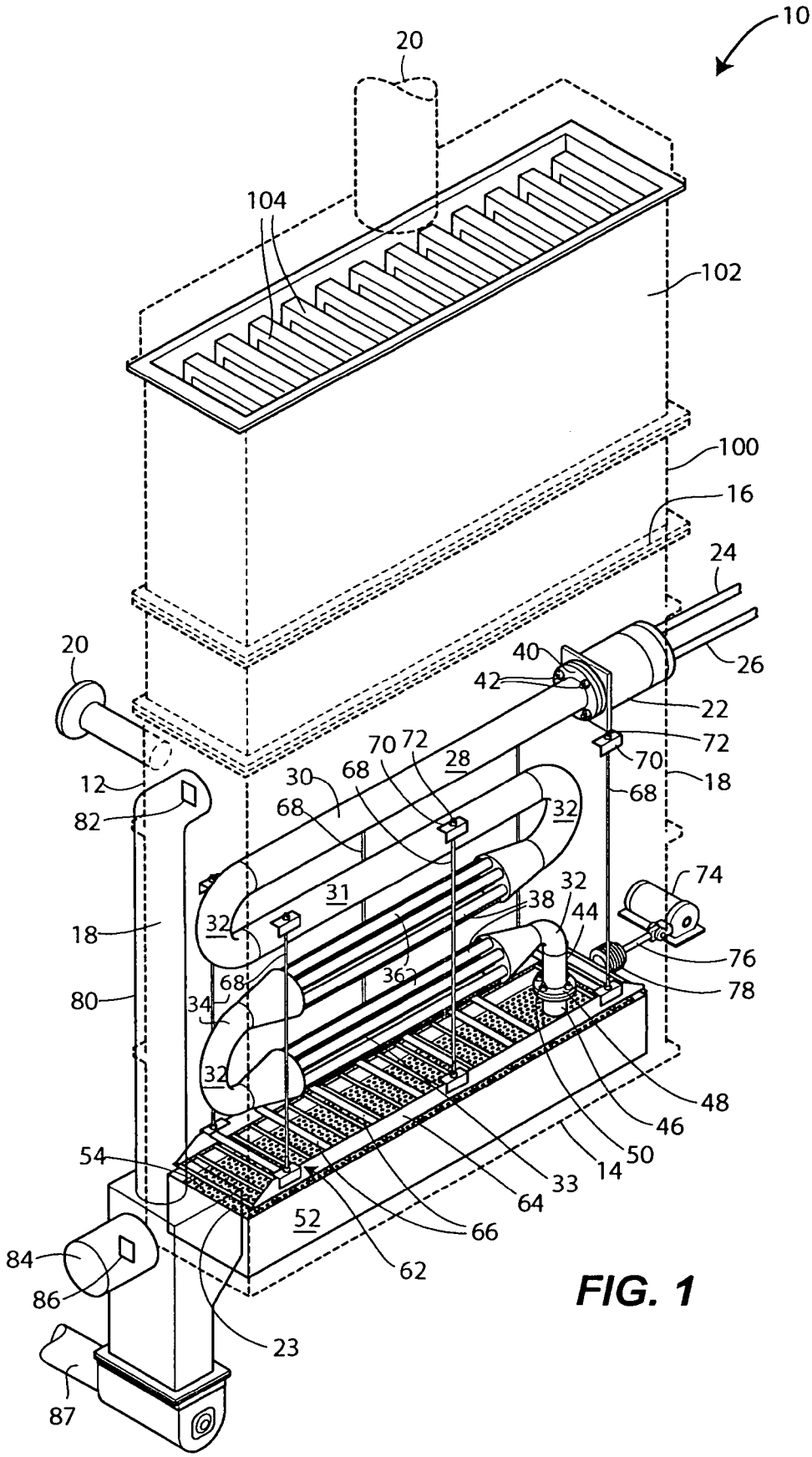
FIG. 1 is a perspective view of a high-efficiency calcining apparatus.
Figure 2:
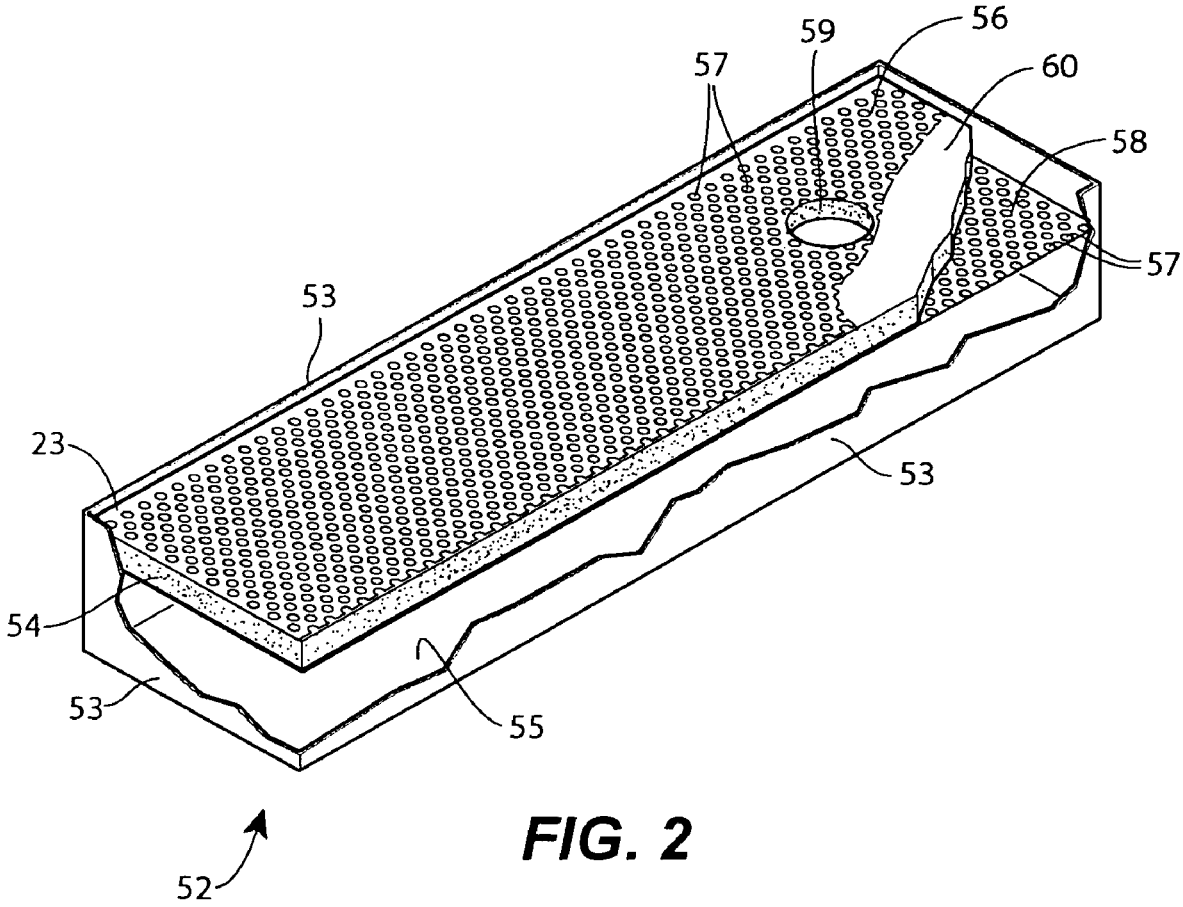
FIG. 2 is a perspective view of fluidization pad partially cut-away to show the layers.
Figure 3:
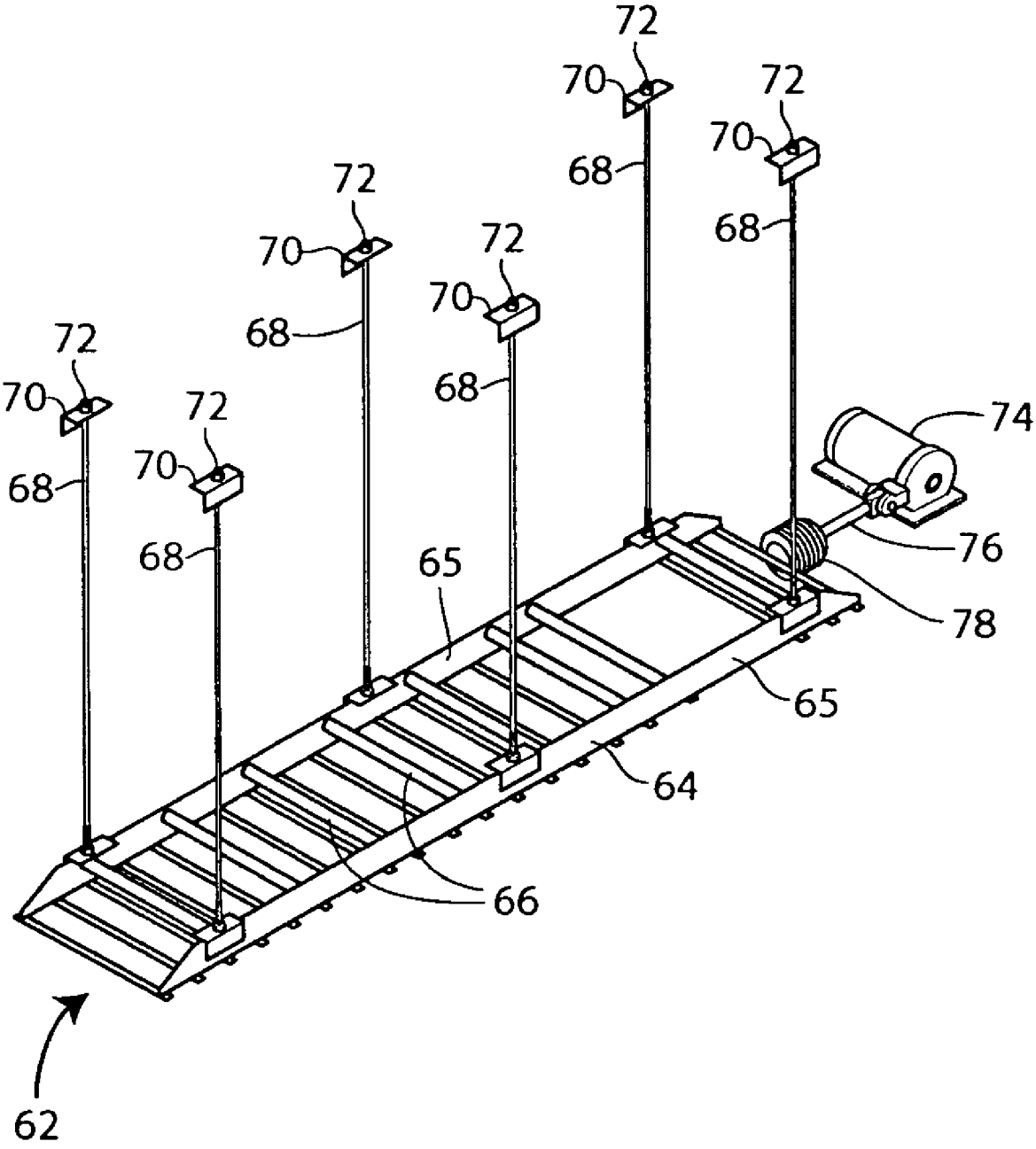
FIG. 3 is a perspective view of an agitation mechanism.

Referring to FIG. 1, an apparatus 10 for calcining gypsum is shown therein. A housing 12 includes a bottom wall 14, an open top 16, and a plurality of side walls 18 extending between the bottom wall 14 and the open top 16. An inlet fixture 20 is located on the housing 12 for receiving crushed or synthetic raw gypsum from a source (not shown) and for transferring the gypsum into the housing 12. At least one burner 22 is connected to the housing 12. The burner 22 is operable for combusting an air-fuel mixture supplied by a forced air conduit 24 and a fuel conduit 26. The burner 22 can be any type known to those skilled in the art, but will typically burn a hydrocarbon based fuel. The heated exhaust from the burner 22 will flow through at least one serpentine shaped burner conduit 28 that extends through a gypsum support floor 23 adjacent the bottom wall 14 of the housing 12. The hot exhaust flow from the burner 22 is utilized to heat the gypsum material to approximately 300° F. In known manner, the heating process converts the gypsum into calcium sulfate hemihydrate, or stucco. Alternatively, the heating process can simply heat wet synthetic gypsum to a desired temperature, typically below 300° F. in order to dry excess moisture from the wet synthetic gypsum for subsequent calcination in a separate process. Alternatively, the heating process can perform the drying and calcination processes in the same vessel.

The burner conduit 28 advantageously includes an elongate linear portion 30 extending away from the burner 22. The linear portion increases the life span of the burner conduit 28. That is, if the flames from the burner 22 were to directly impinge the burner conduit 28 along a curved or angled portion, the flames would overheat the side wall of the conduit causing high stress which shortens the life of the conduit 28. However, due to the presence of the initial elongated linear burner section 30 (which can extend some fifteen to twenty feet in a commercial installation), the burner flames do not directly impinge on the burner conduit, and this is because the flames have converted, along the length of section 30, to hot exhaust gases. Importantly, the burner conduit 28 includes a plurality of curved sections 32 to connect the linear portions 30, 31, and 33, provide the serpentine shape. The burner conduit 28 may include at least one reduced diameter section 34 to provide increased exhaust flow velocity to thereby enhance the heat transfer effectiveness of the conduit 28. The temperature of the exhaust cools proportionally to the distance it moves away from the burner 22, therefore the velocity may be increased to maintain a suitable heat transfer rate. The burner conduit 28 can also include a multi-conduit portion 36 wherein a plurality of relatively smaller diameter conduits 38 are formed to be in fluid communication with relatively larger single conduit portions 32. The smaller diameter conduits 38 provide more surface area for a given effective flow area and thus increase the heat transfer relative to the larger conduit 32. The multi-conduit portions 36 can be connected to the single conduit portions 32 through various means known to those skilled in the art such as welding, brazing, and press fit, mechanical fasteners, etc. The burner conduit 28 can be attached to the burner 22 via a flange 40 with a plurality of threaded fasteners 42. The burner conduit 28 likewise can be attached at the discharge end 44 to an outlet conduit 46 that extends through the support floor 23. The burner conduit 28 can be attached to the outlet conduit 46 via a flange 48 with a plurality of threaded fasteners 50.

A fluidization base 52, shown in FIGS. 1, 2, 4 and 6, (best seen in FIG. 2) can be positioned in a lower portion of the housing 12 to receive exhaust flow from the burner conduit 28. The fluidization base 52 has a plurality of sidewalls 53 extending upwardly from a bottom 55. The fluidization base 52 can have a fluidization pad 54 positioned above the bottom 55 of the fluidization base 52. The fluidization pad 54 forms at least a portion of the support floor 23 of the housing 12. The fluidization pad 54 is operable for containing the gypsum product along the lower portions of housing 12, and for evenly distributing the exhaust flow as it passes from the fluidization base 52 directly into the gypsum. The fluidization base 52 delivers the aeration, the agitation ensures good fluidization especially of cohesive powders that will not otherwise fluidize. The fluidization pad 54 includes first and second outer perforated plates 56, 58. The plates 56, 58 include a plurality of through apertures 57 that permit the exhaust flow to pass therethrough. A bore hole 59 is formed in the fluidization pad 54 to provide access for the conduit 46 (see FIG. 1) to pass through and deliver the exhaust flow to the fluidization base 52. At least one intermediate porous layer 60, formed of a porous fiber mat or woven stainless steel media, is positioned between the outer plates 56, 58. The intermediate layer 60 of media can be made from compressed silica fiber, woven stainless steel mesh or similar materials suitable for fluidization as known to those skilled in the art to withstand high exhaust gas temperatures. The perforated plates 56, 58 are most preferably made from a metal such as stainless steel or the like. The fluidization pad 54 operates by allowing diffused exhaust gas to bubble out through the generally evenly spaced apertures 57 of perforated plate 56. One advantage to using woven stainless steel media 60 is that the perforated plates 56, 58 are not required except to provide support and protection for the media from punctures.

An agitation mechanism 62, shown in FIGS. 1, 3, 4, 6, 7, 8, and 9 (best seen in FIG. 3), can be positioned just above the fluidization pad 54. The agitation mechanism 62 includes an agitator frame 64 having a pair of side beams 65. The agitator frame 64 has a plurality of agitation members 66 connected to the agitator frame 64 for agitating the gypsum product adjacent the fluidization pad 54 along the support floor 23. In one embodiment, the agitation members 66 can take the form of a cross bar pattern. The agitation mechanism 62 locally chums the heated gypsum product when the agitator frame 64 is set into motion. At least one pivotal support arm 68 pivotally connects the agitation frame 64 to the housing 12 (shown in FIG. 1). The connection to the housing 12 can be formed with an angle plate 70 affixed to the housing 12 in a suitable manner such as by welding or mechanically fastening, etc. The support arm 68 can be secured to the angle plate 70 via a threaded fastener 72 or the like. The pivotal support arm 68 is most preferably a cable or similar structure to more easily facilitate a swinging motion by the agitator frame 64 about a common pivot axis when motion is imparted to the agitator frame 64. Alternate moving patterns by the agitator frame 64 are contemplated by the present invention. For example, one skilled in the art would readily understand how to impart motion to the agitator frame 64 in a vertical, horizontal, or arcute pattern, or any combination thereof.

In the form depicted in FIGS. 1, 3, 4, 5, 7, 8 and 9, an actuation power source, such as an electric motor or pneumatic air cylinder 74, can be connected to the agitator frame 64 through an actuator arm 76. An expandable seal 78 is engaged with the actuator arm 76 and the housing 12 (not shown in FIG. 2) to prevent gypsum product from leaking out of the housing 12 about the actuator arm. The seal 78 expands and contracts as the actuator arm 76 moves between first and second positions as the agitator frame 64 swings. Alternatively, the actuator arm 76 can be connected to mechanically leveraged linkages (not shown) that can extend from an actuation power source (not shown) positioned at the top of the housing 12 down to the agitator frame 64 as is known to those skilled in the art. The seal 78 can be made from any suitable material that can withstand temperatures greater than 300 degrees Fahrenheit and pressures up to 10 psig (pounds per square inch gage).

Referring again to FIG. 1, an overflow tube 80 is fluidically connected to the housing 12 to allow processed gypsum to egress from the housing 12 into the overflow tube 80. An overflow valve 82 is associated with the overflow tube 80 to prevent gypsum from egressing from the housing 12 prior to being heated to a predetermined condition. A dump port 84 includes a dump valve 86 that permits the selective draining of the contents in the housing 12. The valves 82, 86 can be of any type known to those skilled in the art, but are most preferably electrically or pneumatically actuated.

Figure 4:
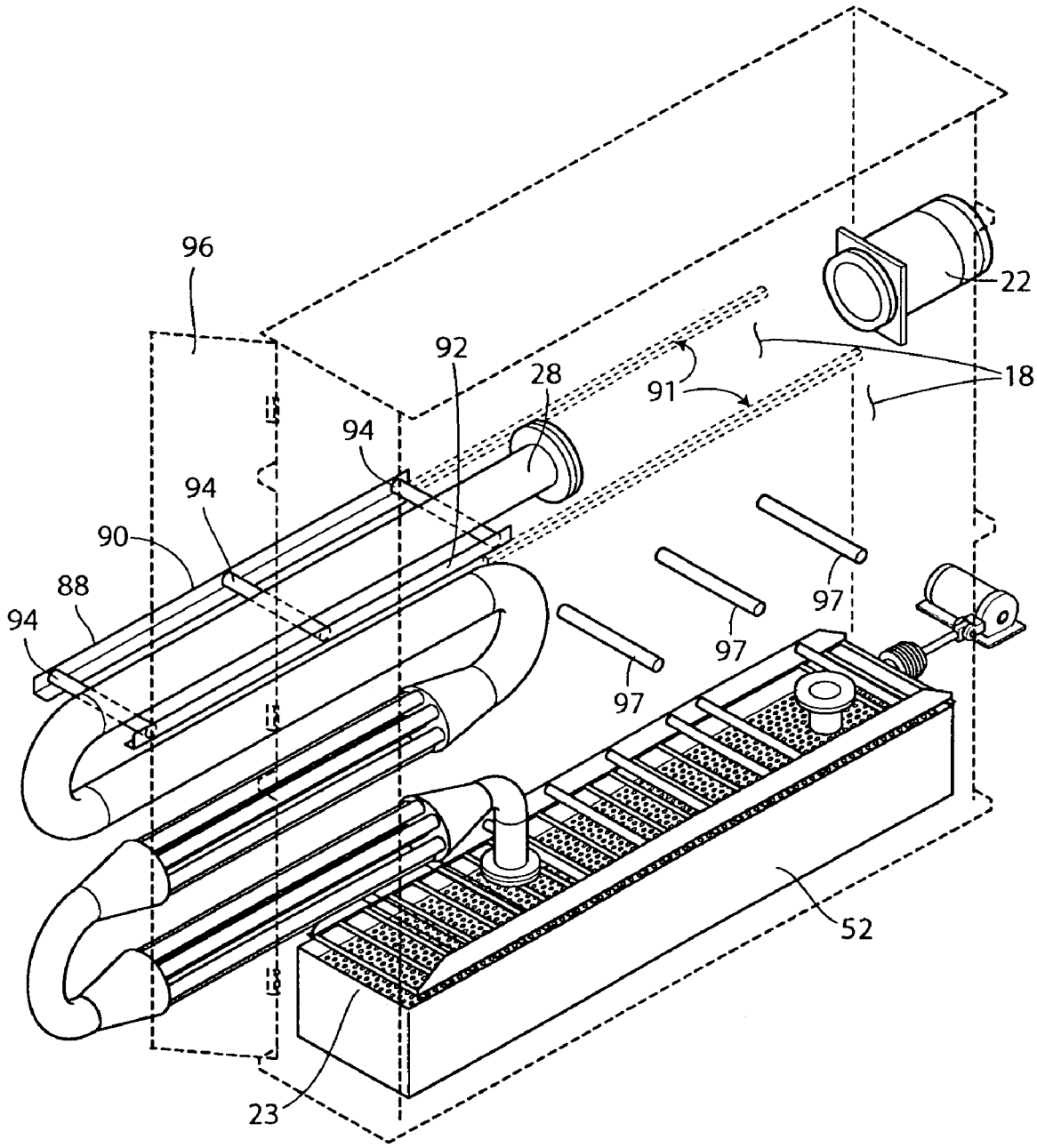
FIG. 4 is the apparatus of FIG. 1 with the burner conduit in an uninstalled position.

Referring now to FIG. 4, a conduit support 88 is slidingly connected to the housing 12 for supporting the burner conduit 28 during installation. The support 88 is operable for sliding between an outer position at least partially external to the housing 12 (shown in FIG. 4) and the installed position inside the housing 12. The conduit support 88 holds the conduit during installation and removal from the housing 12. The support 88 includes a pair of side rails 90, 92 slidingly connected to slide elements 91 formed on parallel walls 18 of the housing 12. A plurality of cross-bars 94 extend between the side rails 90, 92 to provide support surfaces for the burner conduit 28 to rest thereon. The housing 12 includes a side panel 96 operable to open when installing the burner conduit 28. A plurality of ties 97 structurally connects the side walls 18 of the housing 12 to one another to prevent outward bowing of the walls 18 when the housing 12 is filled with gypsum. The ties 97 can be welded or otherwise affixed by any means that is conventional.

Figure 5:
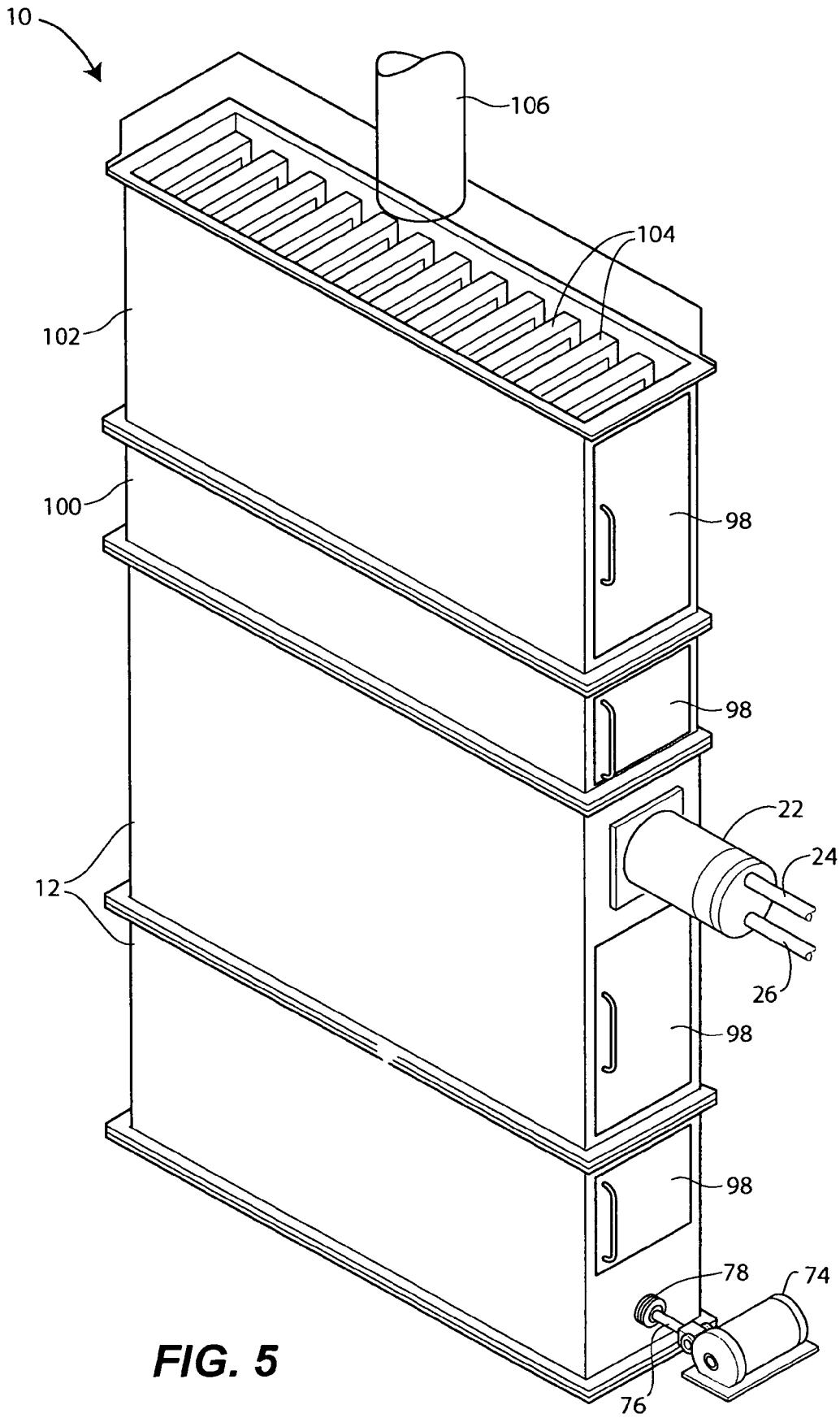
FIG. 5 is the apparatus of FIG. 1 showing a plurality of access panels attached thereto.
Figure 6:
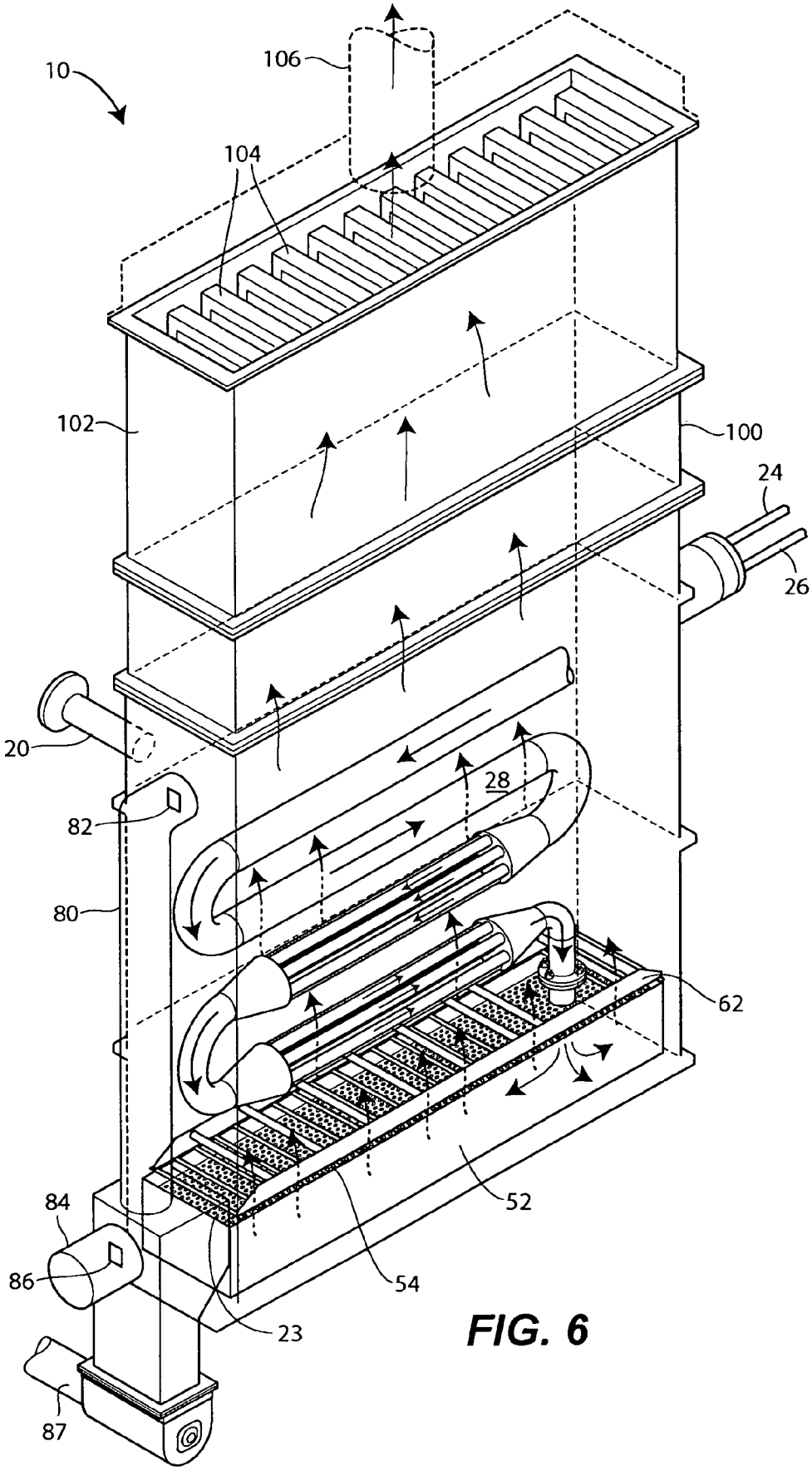
FIG. 6 is a perspective view of the calcining apparatus of FIG. 1 showing the heated gas flow path with arrows.

Referring now to FIG. 5, the apparatus 10 includes access panels 98 located on the side of the housing 12 for permitting servicing of the internal components, such as the burner 22 and the conduit 28, etc. A disengagement chamber 100 is positioned above the open top 16 of the housing 12 and is constructed to permit access thereto for servicing internal components of the housing 12. A dust collector 102 can be positioned above the disengagement chamber 100 to collect gypsum dust particles and recycle the particles back into the housing 12 for calcining. The dust collector 102 can include a plurality of replaceable filters 104. The filters 104 can be of any desired type such as round cartridge filters, bag filters, or the like. The filters 104 can be periodically cleaned by intermittently injecting air through an opposite side of where the dust is collected or by shaking as is known to those skilled in the art. An exhaust stack 106 permits the exhaust to be removed from the apparatus 10 after the gypsum dust particles have been removed by the filters 104.

In operation, gypsum powder is fed into an inlet fixture 20 to fill the housing 12. Air and fuel are supplied by the conduits 24, 26 respectively, to the burner 22. The burner 22 combusts the air-fuel mixture and provides hot exhaust gases which flow in the direction of the arrows shown in FIG. 6. The exhaust flows through the serpentine burner conduit 28 into the fluidization base 52. From the fluidization base 52, the exhaust flows horizontally and then upwardly through the fluidization pad 54 positioned above the base 52. The fluidization pad 54 distributes the exhaust gases through the gypsum product so that the heated exhaust gases are evenly distributed therethrough. The outer surface of the burner conduit 28 provides heat to the gypsum through conduction heat transfer. Thus, the gypsum product is heated both when the exhaust gas flows through the burner conduit 28 and through the gypsum after traveling through the fluidization pad 54. The present invention provides for increased fuel efficiency over the prior art because the dual heating method removes the maximum amount of heat from the exhaust and transfers it into the gypsum. Exhaust gas continues to flow upwardly through the disengagement chamber 100 permitting some of the gypsum particles to separate from the exhaust flow and fall back into the housing 12. The dust collector 102 cleans the airborne gypsum particles from the exhaust gas before exhaust gas egresses through the exhaust stack 106. The gypsum particles can periodically be knocked from the collector filter cartridges (or bags) back into the bed of gypsum.

Advantageously, an agitation mechanism 62 is provided to ensure good fluidization by preventing exhaust from channeling directly through gypsum powder. Natural gypsum typically includes a fine powder that may be too cohesive to achieve good fluidization without agitation. The agitation mechanism 62 is operated by swinging between first and second positions to locally mix the gypsum and scrape it away from the fluidized pad 54. The calcining apparatus 10 has a high efficiency because substantially all of the heat produced by the burner 22 is utilized in heating the gypsum and is not lost through the exhaust process. The temperature of the exhaust gas leaving the gypsum product is approximately 300° F., which is the approximate temperature required for the gypsum to be processed into stucco. Synthetic gypsum that is manufactured with a standard particle size may not require agitation to ensure good fluidization.

Figure 7:
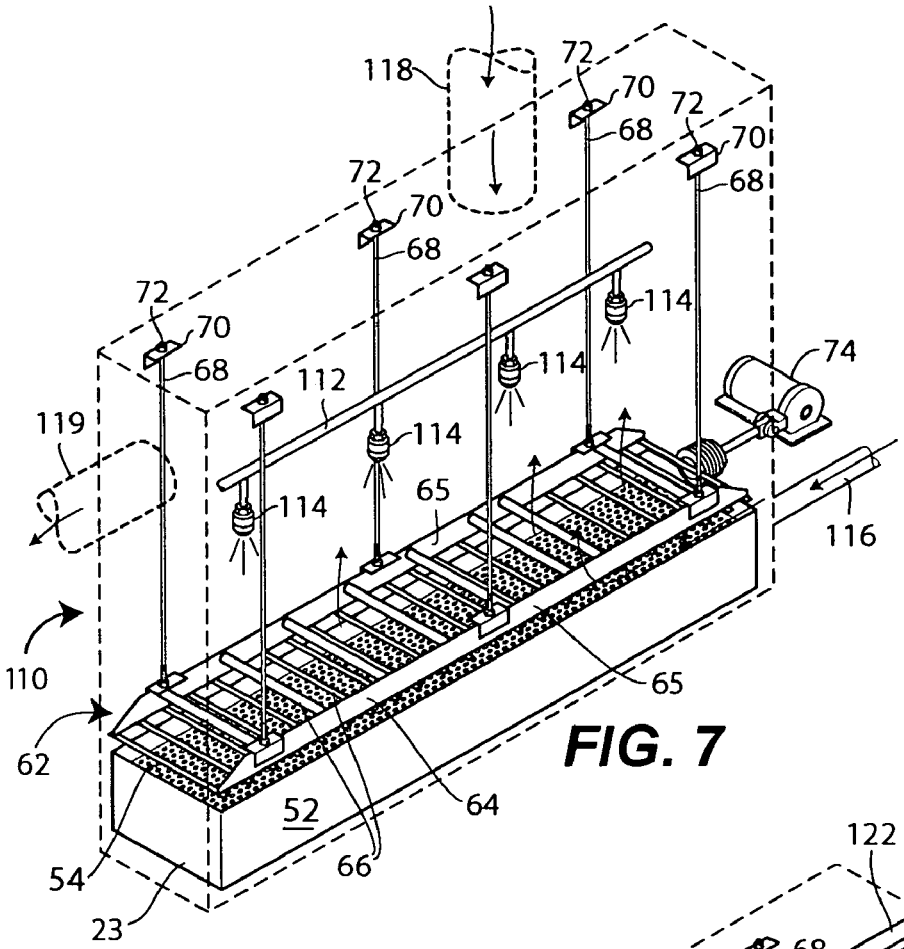
FIG. 7 is a perspective view of a second embodiment of the invention, wherein the agitation mechanism is positioned within a water spray fluid bed stucco cooler.

Referring now to FIG. 7, a water spray fluid bed stucco treater 110 for cooling stucco is shown therein. Hot stucco can enter the water spray treater 110 through an inlet 118. Cooled stucco and fluidization gas can exit through an outlet 119. The water spray stucco treater 110 includes an agitation mechanism 62 having an agitator frame 64. The agitation mechanism 62 includes an agitator frame 64 having a pair of side beams 65. The agitator frame 64 has a plurality of agitation members 66, in the form of cross bar pattern, connected to the frame 64 for agitating the gypsum product adjacent the support base 23. The agitation mechanism 62 locally churns the gypsum product when the frame 64 is set into motion. At least one pivotal support arm 68 pivotally connects the agitation frame 64 to the stucco treater apparatus 110. The connections to the apparatus 110 can be formed with an angle plate 70 affixed to the housing in a suitable manner such as by welding or mechanically fastening, etc. The support arm 68 can be secured to the angle plate 70 via a threaded fastener 72 or the like. The pivotal support arm 68 is most preferably a cable or similar structure to more easily facilitate a swinging motion by the frame 64 about a common pivot axis when motion is imparted to the agitator frame 64. A power source, such as an electric motor 74, can be connected to the agitator frame 64 through an actuator arm 76. The electric motor 74 can be utilized to swing the agitation mechanism 62 about a pivot axis, to agitate the stucco and prevent channeling of the fluidization gases, dead zones, and build-up any where in the fluidized bed, especially along the bottom portion of the apparatus 110. A blower (not shown) injects fluid, such as air, or the like through an inlet 116 formed on the stucco treater 110 to create a fluidized bed of stucco to prevent the stucco from hardening and coagulating adjacent the fluidization pad 54 of the water spray cooler apparatus 110. The apparatus 110 can also include a fluidization base 52 as described above. The water spray cooler 110 includes a water manifold 112 for delivering water to a plurality of spray nozzles 114. The spray nozzles 114 are operable for spraying water into the apparatus 110 and thus cooling the stucco to a predetermined temperature.

Figure 8:
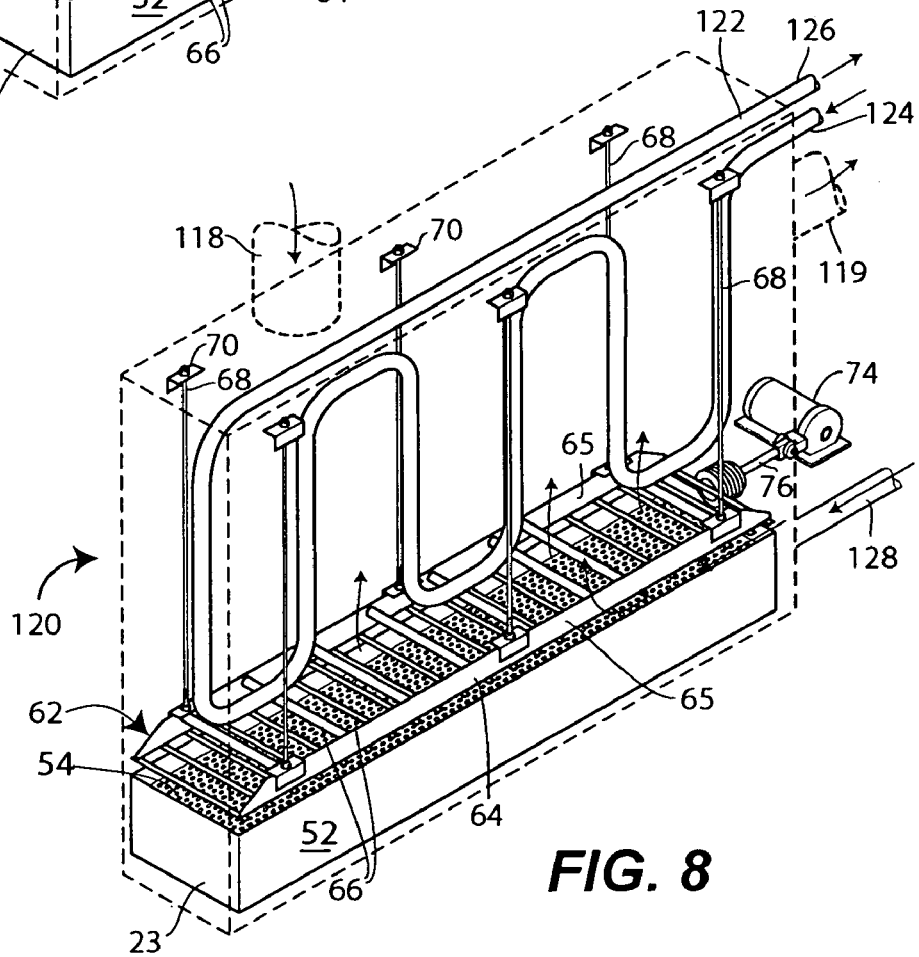
FIG. 8 is a perspective view of a third embodiment of the invention, wherein the agitation mechanism is positioned within a cooling coil fluid bed stucco cooler.

Referring now to FIG. 8, a cooling coil fluid bed stucco cooler 120 is shown therein. Hot stucco can enter the cooling coil stucco cooler 120 through an inlet 118. Cooled stucco and fluidization gas can exit through an outlet 119. The cooling coil stucco cooler 120 includes an agitation mechanism 62 having an agitator frame 64. The agitation mechanism 62 includes an agitator frame 64 having a pair of side beams 65. The agitator frame 64 has a plurality of agitation members 66 connected to the frame 64 for agitating the gypsum product adjacent the support base 23. The agitation mechanism 62 locally chums the gypsum product when the frame 64 is set into motion. At least one pivotal support arm 68 pivotally connects the agitation frame 64 to the cooling coil stucco cooler 120. The connections to the apparatus 120 can be formed with an angle plate 70 affixed to the housing in a suitable manner such as by welding or mechanically fastening, etc. The support arm 68 can be secured to the angle plate 70 via a threaded fastener 72 or the like. The pivotal support arm 68 is most preferably a cable or similar structure to more easily facilitate a swinging motion by the frame 64 about a common pivot axis when motion is imparted to the frame 64. A power source, such as an electric motor 74, can be connected to the frame 64 through an actuator arm 76. The electric motor 74 can be utilized to swing the agitation mechanism 62 about a pivot axis, to agitate the stucco and prevent build-up along the bottom portion of the apparatus 120. A blower (not shown) injects fluid, such as air, through an inlet 128 formed on the cooling coil stucco cooler 120 to create a fluidized bed of stucco and the agitation mechanism 62 prevents the stucco from coagulating adjacent the fluidization pad 54 of the cooling coil stucco cooler 120. The apparatus 110 can also include a fluidization base 52 as described above. The cooling coil stucco cooler 120 includes a serpentine-like cooling coil 122 designed to transport a suitable cooling fluid such as ethylene glycol, chilled water, or the like through the stucco. The cooling coil 122 includes a coolant inlet 124 in which the coolant enters from a supply source (not shown). The coolant follows the serpentine coil 122 and exits from a coolant outlet 126. The coolant traverses the cooling coil 122 to cool the stucco to a predetermined temperature.

Figure 9:
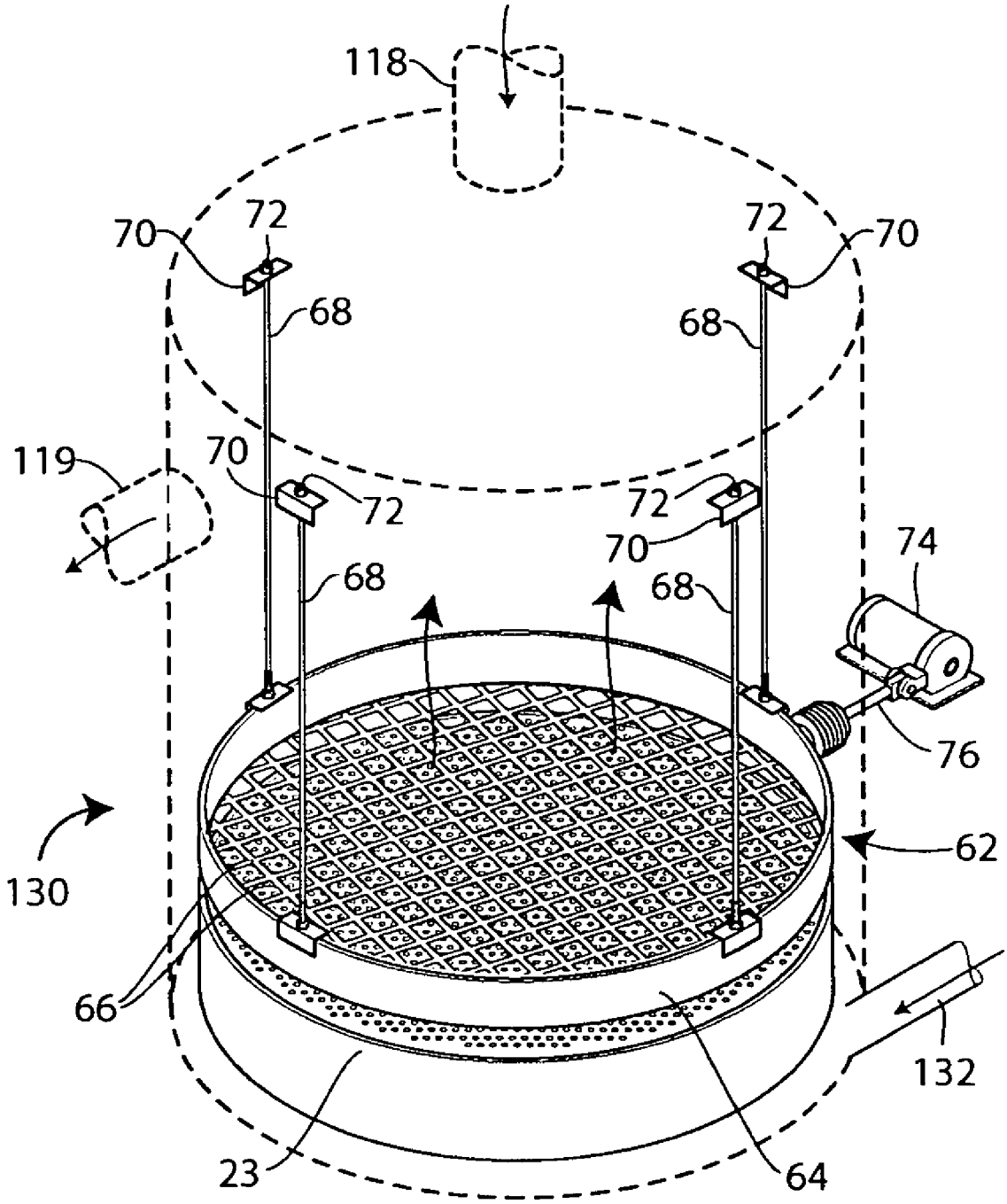
FIG. 9 is a perspective view of a fourth embodiment of the invention, wherein the agitation mechanism is positioned within a post stucco treatment device.

Referring now to FIG. 9, a post stucco treatment retention device 130 is shown therein. Stucco can enter the post stucco treatment retention device 130 through an inlet 118. Stucco and fluidization gas can exit through an outlet 119. The post stucco treatment retention device 130 includes an agitation mechanism 62 having an agitator frame 64 encompassing a plurality of agitation members 66. The agitation members 66 are connected to the frame 64 and are operable for agitating the gypsum product adjacent the support base 23. The agitation mechanism 62 locally chums the gypsum product when the frame 64 is set into motion. At least one pivotal support arm 68 pivotally connects the agitation frame 64 to the stucco retention apparatus 130. The connections to the apparatus 130 can be formed with an angle plate 70 affixed to the housing in a suitable manner such as by welding or mechanically fastening, etc. The support arm 68 can be secured to the angle plate 70 via a threaded fastener 72 or the like. The pivotal support arm 68 is most preferably a cable or similar structure to more easily facilitate a swinging motion by the frame 64 about a pivot axis when motion is imparted to the frame 64. A power source, such as an electric motor 74, can be connected to the frame 64 through an actuator arm 76. The electric motor 74 can be utilized to swing the agitation mechanism 62 about a pivot axis, to agitate the stucco and prevent build-up along the bottom portion of the apparatus 130. In the illustrative embodiment, the post stucco treatment retention device 130 is shown as having a round cross section, however, various cross sectional geometries can be used with the agitation mechanism 62. The post stucco treatment retention device 130 typically will include a blower (not shown) to provide fluid, such as pressurized air, through an inlet 132 formed on the retention device 130.

Figure 10:
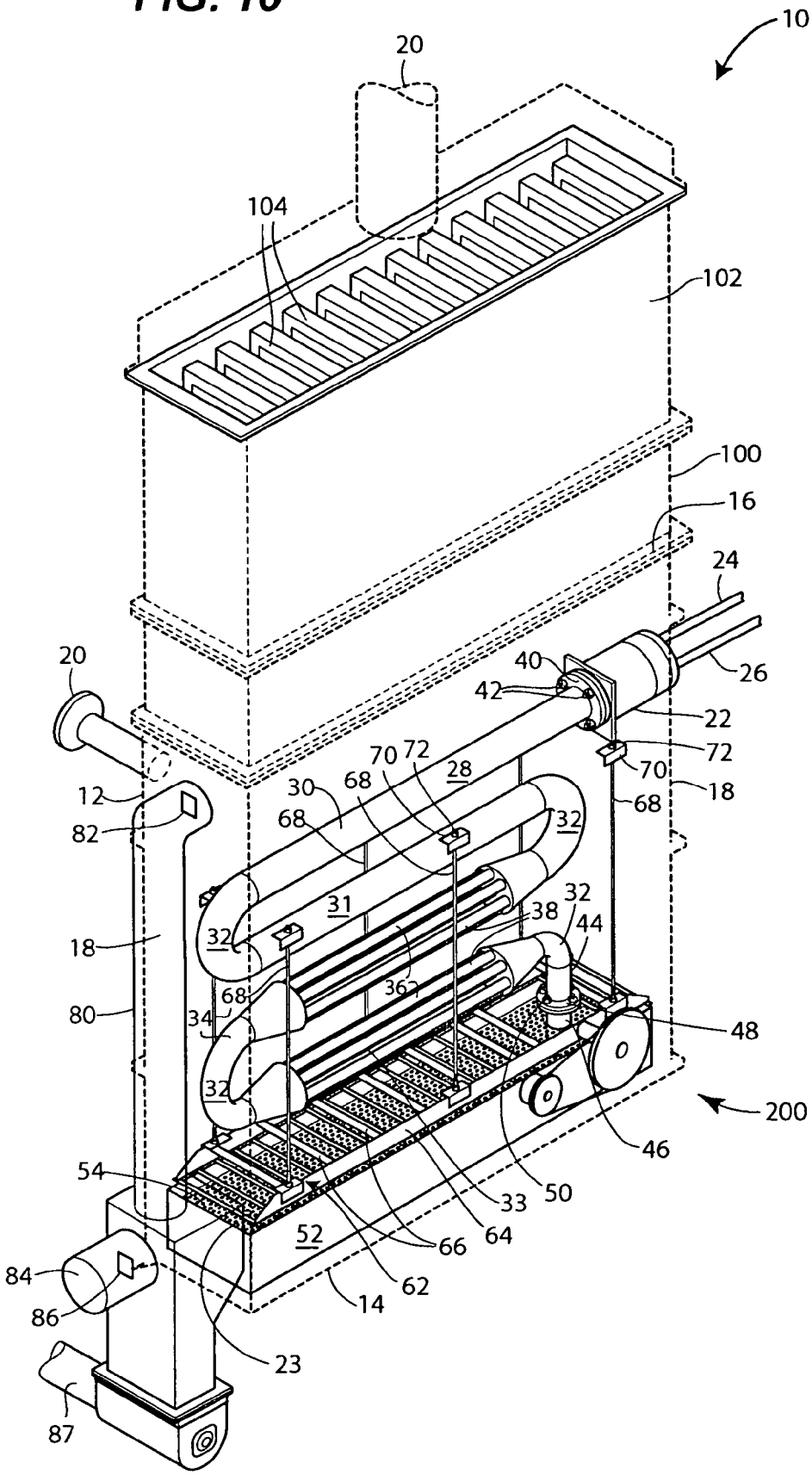
FIG. 10 is a perspective view of an alternate form of a high-efficiency calcining apparatus.

While the present disclosure has, thus far, described the use of an electric motor or pneumatic cylinder 74 connected to the agitator frame 64 through an actuator arm 76, alternate forms of the calcining apparatus 10 may include alternate devices for agitating the agitator frame 64. For example, FIG. 10 depicts one alternate form of the high-efficiency calcining apparatus 10 including a cam-drive device 200. The cam-drive device 200 is disposed in front of the fluidization base 52, as oriented in FIG. 10, as opposed to being disposed on the side of the fluidization base 52, as the pnueumatic cylinder 74 is depicted in FIGS. 1, 3-5 and 7-9.

Figure 11:
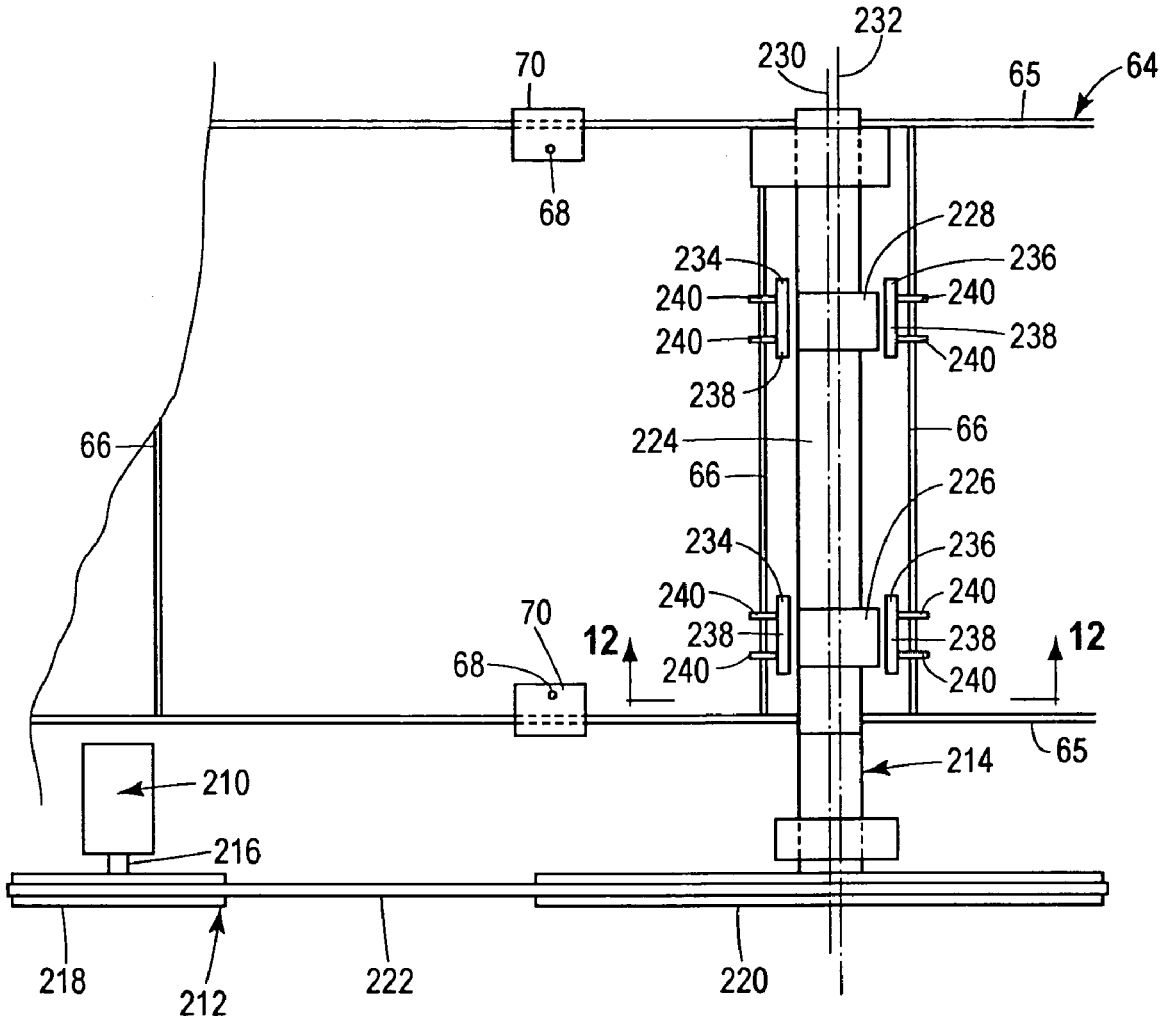
FIG. 11 is a top view of an agitator mechanism and cam-drive device according to the form of the high-efficiency calcining apparatus of FIG. 10.
Figure 12A:
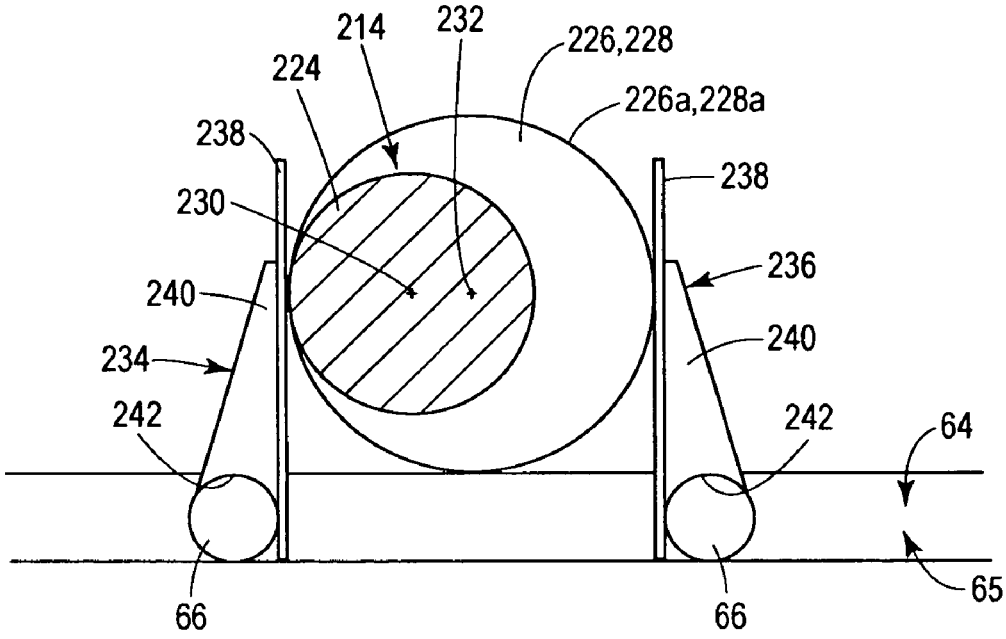
FIG. 12A is a cross-sectional side view of the cam-drive device of FIG. 11 taken through line 12-12 of FIG. 11 in a first rotational position.
Figure 12B:
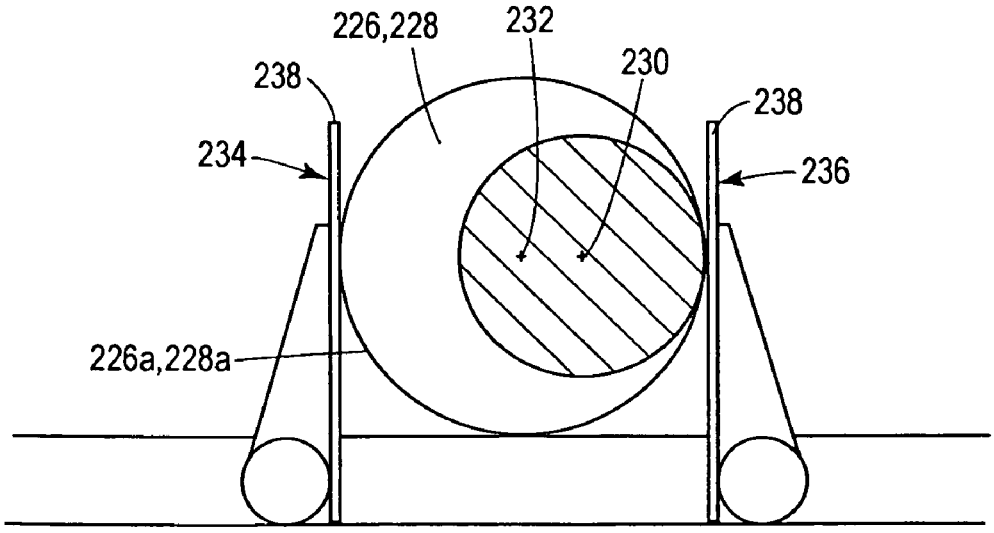
FIG. 12B is a cross-sectional side view of the cam-drive device of FIG. 11 taken through line 12-12 of FIG. 11 in a second rotational position.

FIGS. 11, 12A and 12B illustrate the cam-drive device 200 in more detail. Specifically, the cam-drive device 200 includes an eccentric cam device having a drive source 210, a power transfer assembly 212, and a drive rod 214. The drive source 210 provides torque to the power transfer assembly 212, which rotates the drive rod 214 to displace the agitator frame 64 in a manner similar to that described above.

More specifically, in one form, the drive source 210 includes an electric motor having an output shaft 216. In other forms, the drive source 210 may include a gas-powered motor, or any other rotary drive source. The power transfer assembly 212 includes a driven sprocket 218, a drive sprocket 220, and a chain 222. The driven sprocket 218 is fixedly attached to the output shaft 216 of the drive source 210. The drive sprocket 220 is fixedly attached to the drive rod 224.

The drive source 210 operates to rotate the output shaft 216 and therefore the driven sprocket 218. The driven sprocket 218 transfers torque from the drive source 210 to the drive sprocket 220 via the chain 22. It should be appreciated that in an alternate form, the power transfer assembly may include one or more intermediate sprockets, a chain tensioner mechanism, or any other device operable to serve the principles of the present disclosure. In another alternate form, the power transfer assembly 212 may not include sprockets and a chain at all, but rather a belt and one or more fly-wheels accommodating the belt.

The drive rod 214 includes a central rod portion 224, a first eccentric cam 226, and a second eccentric cam 228. As depicted in FIGS. 12A and 12B, the central rod portion 224 has a substantially cylindrical cross-section and a longitudinal axis identified by reference numeral 230. The drive rod 214, as mentioned above, is fixedly attached to the drive sprocket 220 such that, when rotated, the drive rod 214 rotates about the axis 230 of the central rod portion 224. The first and second eccentric cams 226, 288 are also substantially cylindrical in cross-section and have a common longitudinal axis identified by reference numeral 232. The longitudinal axis 230 of the central rod portion 224 is parallel to and offset from the longitudinal axis 232 of the eccentric cams 226, 228. The eccentric cams 226, 228 also include eccentric surfaces 226*a*, 228*a* for reciprocally driving the agitator frame 64, as will be described in more detail below.

In the form depicted in FIGS. 10-12B, the agitator mechanism 62 includes, in addition to the agitator frame 64, a pair of first brackets 234 and a pair of second brackets 236. Each of the four brackets 234, 236 are identical to one another. The first pair of brackets 234 are disposed directly opposite the first and second eccentric cams 226, 228 from the second pair of brackets 236. The brackets 234, 236 are adapted to be engaged by the eccentric cams 236, 238 as the drive rod rotates. In the form described and depicted herein, this engagement operates to convert the torque in the cams 234, 236 to linear displacement of the agitator frame 64, as will be described further below.

With reference to FIGS. 12A and 12B, the brackets 234, 236 will be described in more detail. Each of the brackets 234, 236 include a back plate 238 and a pair of legs 240 (shown as a pair in FIG. 11). The back plates 238 are generally flat rigid members having inner surfaces 238*a* adapted for engagement with the eccentric surfaces 226*a*, 228*a* of the eccentric cams 226, 228. The legs 240 are flat generally rectangular members with arcuate lower surfaces 242. The legs 240 are fixedly attached to the back plates 238. The arcuate lower surfaces 242 receive agitation members 66 of the agitation mechanism 62. In one form, the arcuate surfaces 242 are fixedly attached to the agitation members 66 via welding or some other form of fixation device.

Accordingly, during operation, the drive source 210 rotationally drives the driven sprocket 218 to move the chain 222 and drive the drive sprocket 220. The drive sprocket 220 rotates the drive rod 214 about the axis 230 of the central rod portion 224. This rotation causes the eccentric cams 226, 228 to likewise rotate about the axis 230 of the central rod portion 224. With reference to FIGS. 12A and 12B, it should be appreciated that the axis 232 of the eccentric cams 236, 238 orbits about the axis 230 of the central rod portion 224. Therefore, while the drive rod 214 is in the rotational position depicted in FIG. 12A, the eccentric surfaces 226*a*, 228*a* of the eccentric cams 226, 228 engage the back plates 238 of the second brackets 236, thereby displacing the agitator frame 64 to the right-hand side of FIGS. 11 and 12. As the drive rod 214 continues to rotate, for example, in a clockwise direction relative to FIG. 12A, the eccentric cams 226, 228 orbit below the central rod portion 224 and to the left side of the central rod portion 224, as depicted in FIG. 12B. So configured, the eccentric surfaces 226*a*, 228*a* of the eccentric cams 226, 228 engage the back plates 238 of the first brackets 234, thereby displacing the agitator frame 64 to the left-hand side of FIGS. 11 and 12. It should therefore be appreciated that continuous rotation of the drive rod 214 and eccentric cams 226, 228 causes the eccentric cams 226, 228 to periodically engage the brackets 234, 236 and reciprocally displace the agitator frame 64 to agitate the gypsum in the calcining apparatus 10 of the present disclosure.

It should also be understood that while the cam-drive device 200 has been described herein as including two eccentric cams 226, 228, an alternate form of the cam-drive device 200 may include any number of eccentric cams 226, 228. Additionally, while the above-described cam-drive device 200 has been depicted as including a drive rod 214 that extends substantially across the agitator frame 64, an alternate form may include a substantially shorter drive rod that merely attaches to a side beam 65 that is oriented on the front or the rear of the calcining apparatus 10, as depicted in FIG. 11. Finally, while the cam-drive device 200 has been described as being adapted to the generally rectangular calcining apparatus 10 depicted in FIGS. 1, 4-8 and 10, the cam-drive device 200 could also be adapted to the generally circular calcining apparatus depicted in FIG. 9. In such a case, the drive rod 214 may extend substantially across a central portion of the agitator frame 64 or a portion off-center of the agitator frame 64. In either case, the cam-drive device 200 would work substantially identically to that described above.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. An agitation mechanism for a gypsum processing apparatus comprising:

a housing having a bottom wall, at least one sidewall, and a support base above and adjacent the bottom wall, the housing constructed and arranged to receive and process powdered gypsum;

a fluidization mechanism for introducing fluid to the gypsum based product, the fluid traversing from near the bottom wall toward the top wall;

an agitator frame having a similarly shaped cross section to a cross section of the housing, the agitator frame pivotally connected internally to the housing for reciprocating movement between first and second positions, the agitation mechanism operable for preventing the fluidized gypsum product from collecting along a support base adjacent the bottom wall of the housing; and an eccentric cam to provide a connection between the motor and the agitator frame.

2. The apparatus of claim 1, wherein the agitator mechanism further comprises:

a bracket fixed to the agitator frame; and a rigid rod rotational driven by the electric motor and supporting the eccentric cam.

3. The apparatus of claim 2, wherein the rigid rod rotates the eccentric cam such that the eccentric cam periodically engages the bracket to reciprocally displace the agitator frame.

4. The apparatus of claim 2, further comprising a sprocket operably coupling the rigid rod to the electric motor.

5. The apparatus of claim 1, wherein the agitator frame corresponds to a housing having a rectangular cross section.

6. The apparatus of claim 1, wherein the agitator frame corresponds to a housing having a circular cross section.

7. The apparatus of claim 1, wherein the agitator frame corresponds to a housing having one of any geometric cross section constructed and arranged to process a gypsum based product.

8. The apparatus of claim 1, wherein the process includes calcining gypsum.

9. The apparatus of claim 1, wherein the apparatus is a fluidized bed stucco cooler utilizing water injection.

10. The apparatus of claim 1, wherein the apparatus is a fluidized bed stucco cooler utilizing cooling coils.

11. The apparatus of claim 1, wherein the apparatus is a post stucco treatment retention device.

12. The apparatus of claim 1, wherein the agitation mechanism includes a plurality of agitation members connected to the agitator frame for agitating the gypsum product adjacent the support base when the agitator frame moves.

13. The apparatus of claim 1, wherein the reciprocating movement is a swinging movement.

14. The apparatus of claim 1, wherein the agitation mechanism includes at least one pivotable support arm for pivotally connecting the agitator frame to the apparatus.

15. The apparatus of claim 14, wherein the at least one pivotable support arm is a cable pivotally attached internally to the housing at one end and to the agitator frame at the other end, the agitator frame being operable for swinging about a pivot axis when motion is imparted thereto.

16. The apparatus of claim 1, wherein the agitation mechanism includes a power source to move the agitator frame.

17. The apparatus of claim 16, wherein the power source includes one of an electric motor and a powered air cylinder.

18. An agitation mechanism for a fluidized gypsum processing apparatus comprising:

a housing having a bottom wall, and at least one sidewall, the housing constructed and arranged to receive and process gypsum based products;

a fluidization mechanism for introducing fluid to the gypsum based product, the fluid traversing from near the bottom wall toward the top wall;

an agitator frame pivotally connected internally to the housing for reciprocating movement between first and second positions, the agitation mechanism operable for preventing fluid channeling, dead pockets of non fluidized gypsum, and for preventing the gypsum product from collecting adjacent the bottom wall of the housing;

at least one pivotable support arm for pivotally connecting the agitator frame to the apparatus, wherein the at least one pivotable support arm is a cable pivotally attached internally to the housing at one end and to the frame at the other end, the agitator frame being operable for swinging about a pivot axis when motion is imparted thereto; and an eccentric cam to provide a connection between the motor and the agitator frame.

19. The apparatus of claim 18, wherein the agitation mechanism includes a plurality of agitation members connected to the agitator frame for agitating the gypsum product adjacent the bottom wall when the agitator frame moves.

20. The apparatus of claim 19, wherein the agitation members comprise cross members.

21. The apparatus of claim 18, wherein the agitation mechanism includes a power source to move the agitator frame.

22. The apparatus of claim 21, wherein the power source includes one of an electric motor and a pneumatic actuator.

23. The apparatus of claim 18, wherein the agitator mechanism further comprises:

a bracket fixed to the agitator frame; and a rigid rod rotational driven by the electric motor and supporting the eccentric cam.

24. The apparatus of claim 23, wherein the rigid rod rotates the eccentric cam such that the eccentric cam periodically engages the bracket to reciprocally displace the agitator frame.

25. The apparatus of claim 24, further comprising a sprocket operably coupling the rigid rod to the electric motor.

26. The apparatus of claim 18, wherein a cross-section of the agitator frame corresponds to a housing having a rectangular cross section.

27. The apparatus of claim 18, wherein a cross-section of the agitator frame corresponds to a housing having a circular cross section.

28. The apparatus of claim 18, wherein a cross-section of the agitator frame corresponds to a housing having one of any geometric cross section constructed and arranged to process a gypsum based product.

29. The apparatus of claim 18, wherein the process includes calcining gypsum.

30. The apparatus of claim 18, wherein the apparatus is a fluidized bed stucco cooler utilizing water injection.

31. The apparatus of claim 18, wherein the apparatus is a fluidized bed stucco cooler utilizing cooling coils.

32. The apparatus of claim 18, wherein the apparatus is a post stucco treatment retention device.

* * * * *